United States Patent [19]

Rabe

[11] Patent Number: 4,641,545

[45] Date of Patent: Feb. 10, 1987

[54] SINGLE LEVER CONTROL ARRANGEMENT

[75] Inventor: Bernd Rabe, Dellfeld, Fed. Rep. of Germany

[73] Assignee: Deere & Company, Moline, Ill.

[21] Appl. No.: 725,182

[22] Filed: Apr. 19, 1985

[30] Foreign Application Priority Data

May 5, 1984 [EP] European Pat. Off. ..... 84105076.8

[51] Int. Cl.[4] ..... G05G 9/08

[52] U.S. Cl. ..... 74/476; 74/480 R; 74/526; 74/538

[58] Field of Search ..... 74/476, 480 R, 480 B, 74/526, 538, 876; 192/0.096, 0.098

[56] References Cited

U.S. PATENT DOCUMENTS

| | | | |
|---|---|---|---|
| 2,394,985 | 2/1946 | Court | 74/536 |
| 3,085,447 | 4/1963 | Shay | 74/480 X |
| 3,134,269 | 5/1964 | Shimanckas | 74/472 |
| 3,153,945 | 10/1964 | Mitchell | 192/0.098 X |
| 3,250,350 | 5/1966 | Shimanckas | 192/0.096 |
| 3,530,736 | 9/1970 | Houk | 74/469 |
| 4,106,604 | 8/1978 | Baba | 74/480 B X |
| 4,140,027 | 2/1979 | Wineburner | 74/471 R |
| 4,215,771 | 8/1980 | Huitema | 192/3.54 |
| 4,445,394 | 5/1984 | Yapp et al. | 74/501 R |

FOREIGN PATENT DOCUMENTS

| | | | |
|---|---|---|---|
| 1023296 | 3/1966 | United Kingdom | 74/876 |

*Primary Examiner*—Allan D. Herrmann

[57] ABSTRACT

In a single lever control for the feeder conveyors of a combine harvester, movement of a manually operated lever directly actuates a drive train for driving the conveyors in a forward or normal operating direction. A second lever controls actuation of a drive train for driving the feeder conveyors in a reverse direction. Movement of the second lever is responsive only to movement of the first through a cam slot and cam follower arranged so that selection of the drive for one direction automatically disengages the drive for the opposite direction. A detent gate at the neutral position forces the operator to pause when passing through the neutral position, that is when disengaging one drive and engaging the other.

6 Claims, 3 Drawing Figures

SINGLE LEVER CONTROL ARRANGEMENT

BACKGROUND OF THE INVENTION

The invention concerns a lever-actuated control system and, more particularly, one in which movement of a single control lever selectively controls the actuation of at least two devices in a machine.

Arrangements of this general type are well known (see, for example, U.S. Pat. Nos. 3,530,736 Houk and 4,215,771 Huitema) but even when they control only two devices or functions the known arrangements tend to be relatively complex and high in manufacturing cost.

SUMMARY OF THE INVENTION

Accordingly, an object of the invention is to provide a simple inherently robust single lever arrangement for controlling two or more devices in a machine, potentially low in manufacturing cost and, preferably, one which facilitates prevention of simultaneous engagement of a first and second one of the devices.

According to the invention, in a machine, a first device is controlled directly by a first manually manipulated lever and a second device is controlled (indirectly) by a second lever directly responsive to, and controlled by, movement of the first lever. Preferably, the two levers are interconnected so that the position of the second lever is entirely and positively determined by the position of the first.

In a preferred embodiment, a plurality of camming surfaces such as a cam track or slot carried by one of the levers is engaged by a cam follower carried by the other. Both levers are mounted for pivoting or rocking movement about respective spaced-apart pivot axes, both axes being fixed with respect to the machine and hence to each other. The camming surfaces may define a slot sized for precise guidance of the cam follower and the slot may include two principal portions, a first one of which defines a circular arc disposed to be concentric with the pivot axis of the first lever when engaged by the cam follower, and a contiguous second portion extension of this slot deviating from the concentric arc portion. The operating range for the first lever includes a first phase, in which the cam follower engages the concentric arc portion of the slot and movement of the first lever leaves the position of the second lever unchanged (a dwell period), and a second phase in which the cam follower engages the nonconcentric portion of the slot and movement of the first lever causes a shift in the second lever, pivoting it about its own pivot axis.

The first lever may be directly connected by a linkage for actuation of a first device and the second lever may be connected so that its induced movement actuates a second device. Thus, movement of the single first lever may conveniently provide sequential and nonoverlapping function of the two devices.

When a control arrangement according to the invention is used to effect nonoverlapping operation or actuation of two devices, it may be desirable to impede movement of the first lever so that there is a pause between disengagement of the first device and engagement of the second. To achieve this, the control system may include a gate or stop arrangement effective at a first lever position corresponding to the transition between the first and second portions of the camming slot, that is at the transition from disengagement of the first device to engagement of the second. This arrangement is especially useful when the first and second devices are mechanically connected, such as the forward and reverse drive modes of elements such as those in a conveyor system of a harvester header. A control arrangement according to the invention is particularly adaptable for controlling the conveyors of a harvester header where the first device corresponds to the normal forward operating mode of the header and the second device corresponds to a drive arrangement for driving the header conveyors in reverse for clearance of blockages.

DESCRIPTION OF THE PREFERRED EMBODIMENT

Figure 1:
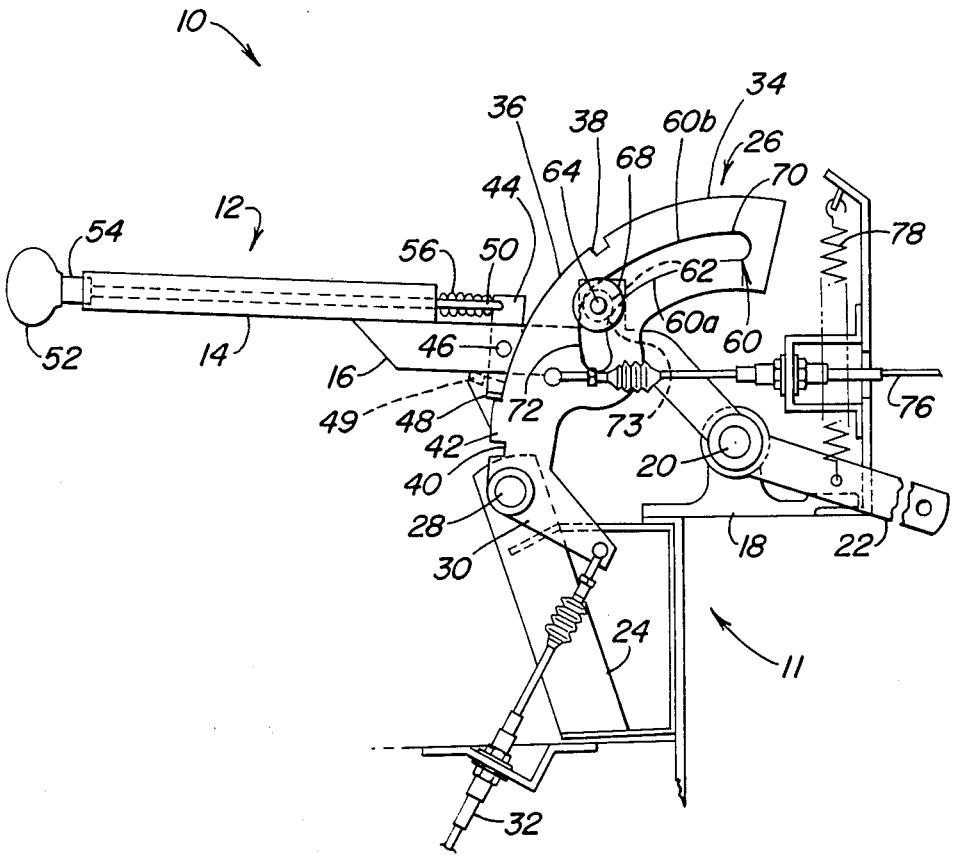
FIG. 1 is a side elevation of a single lever arrangement for controlling the conveyor drives of a header of a mobile harvester including a normal, forward, operating drive and a reverse drive. Only tne input end of the control system is shown. The lever is shown in a neutral position with both drives disengaged.

The invention is embodied in the operator input end of a single lever control arrangement 10 for the conveyor elements of the header of a combine harvester, including a transverse crop converging platform auger and a feederhouse conveyor for carrying gathered crop material into the body of the combine for processing. The drawings show only the input end of the control arrangement. The control arrangement 10 is supported on frame members of the combine designated collectively by the numeral 11 and preferably at the operator's station of the combine.

The single or primary control lever 12 of the control arrangement 10 consists of a tubular member 14 welded to a lever arm 16 of flat cross section pivotably carried in a bearing 18 supported by the frame 11 and retained by a pivot pin 20. An extension 22 of the lever arm 16 is operably connected to a clutch (not shown) in the drive train for forward operation of the header conveyors.

A pivot bracket 24, also carried by the frame 11, provides pivot support for a secondary lever 26 pivotably connected to the bracket 24 by pivot pin 28. An extension 30 of the secondary lever 26 is connected by means of a sheathed cable arrangement 32 to a clutch (not shown) in the drive train for reverse operation of the header conveyors.

The main portion 34 of the secondary lever 26 is of generally arcuate form and has an outside arcuate guide surface 36 with spaced-apart radially extending notches 38 and 40, respectively. The notch 40 is bordered by a radially raised abutment 42. A detent arrangement includes a latch 44 pivotably carried on the lever arm 16 by a pivot pin 46 and including a bent up nose portion or tang 48 engageable with the notches 38 and 40. The main portion 34 of the secondary lever arm 26 also carries, spaced radially outwards from the guide surface 36 close to the abutment 42, a stop 49. The detent latch 44 is controlled generally conventionally through a link 50 connected at its outer end to an operating knob 52 having an extension 54 and biased by a spring 56.

The secondary control lever 26 is positionally related to the primary control lever 12 through the camming effect of a generally arcuate slot 60 in the secondary lever 26 and a cam follower roller 62 carried by the lever arm portion 16. The roller 62 is retained by a pin 64 and washer 68 cooperating with the lever arm portion 16 on the opposite side of the curved lever arm portion 34 to retain the cam follower roller 62 in engagement with the guide slot 60.

The guide slot 60 is defined by radially inner and outer camming surfaces 60*a* and 60*b*, respectively, and consists of a main portion 70 of circular arc shape and a shorter portion 72 angled away from the arc of the portion 70 and connected to it by a smooth transitional curved portion 73.

A second sheathed control cable 76 connected to the secondary lever 26 controls a hydraulic valve (not shown) in the reverse drive arrangement for the header conveyor system.

The bias of a tension spring 78 connected between the frame 11 and the primary lever extension 22 helps reduce operator effort in manipulating the single control lever 12.

Figure 2:
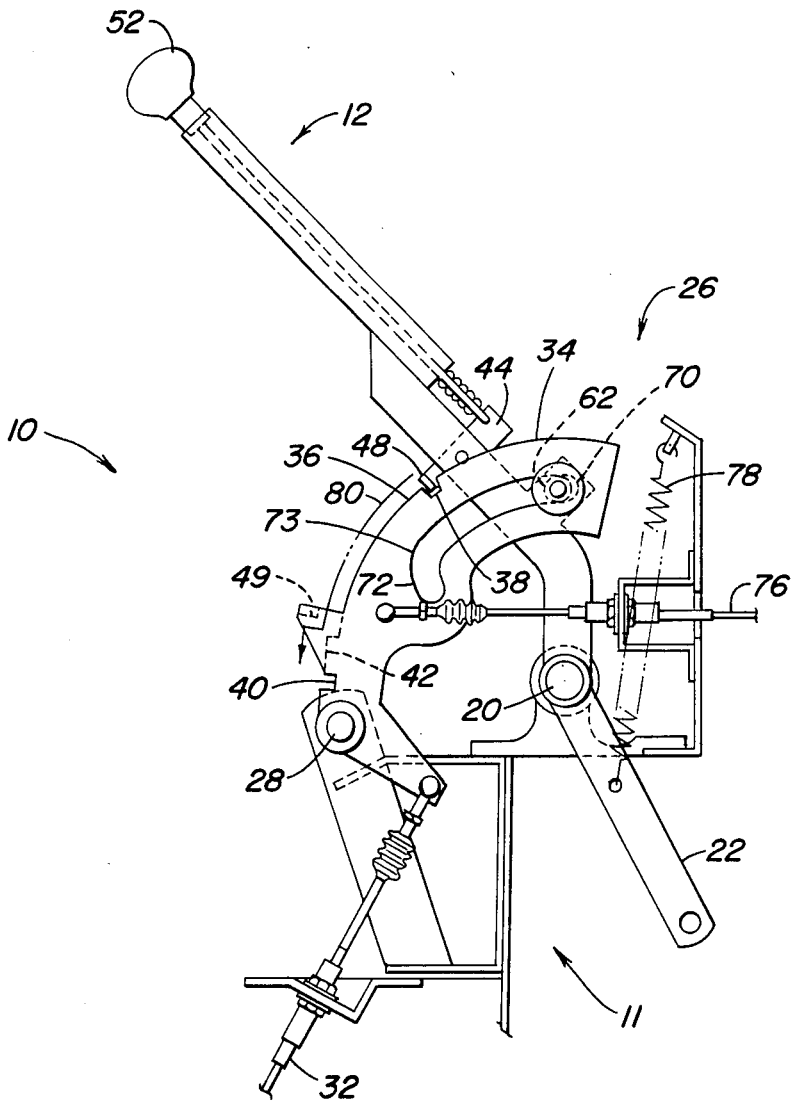
FIG. 2 is similar to FIG. 1 with the single control lever in a position for maintaining engagement of the forward drive.

The parts of the control arrangement 10 are configured and dimensioned so that when the cam following roller 62 of the primary lever 12 is engaged by the main arcuate portion 70 of the guide slot 60 (as, for example, shown in FIGS. 1 and 2) the slot 70 is concentric with the pivot axis of the primary lever 12 as defined by the center of the pivot pin 20.

In operation, to select normal forward operating drive for the header conveyor system, control lever 12 is moved upwards (or clockwise as seen in the drawings) with the detent tang 48 following the guide surface 36 of the secondary lever 26 until, biased by the spring 56, the detent tang may drop into the notch 38. The corresponding movement of the control lever extension portion 22 is sufficient to engage the drive clutch in the drive train for maintained forward operation of the header conveyors. This movement of the lever 12 from the neutral position of FIG. 1 to the forward engagement position of FIG. 2 moves the cam follower roller 62 along the main portion 70 of the guide slot 60 but, because of the concentricity of this portion of the guide slot with the lever pivot axis (20), the position of the secondary lever 26 remains unchanged.

To disengage the forward drive of the header conveyor system and return to a neutral position, the control knob 52 of the lever 12 must be depressed to unlatch the detent 44 so that the lever 12 can be swung anticlockwise, down to the position of FIG. 1 again, in which the detent tang 48 engages the abutment 42. This occurs automatically if the control lever knob 52 is released after disengagement from the notch 38 so that the detent tang 48 may follow the guide surface 36 under the action of the spring 56. The control lever 12 will also be stopped at the neutral position even if the control knob 52 is held in a depressed position because the detent tang 48 will be positioned radially outward of the guide surface 36 and will engage the stop 49. Thus, in either case, a pause or stop at the neutral position of the control lever 12 is assured.

Figure 3:
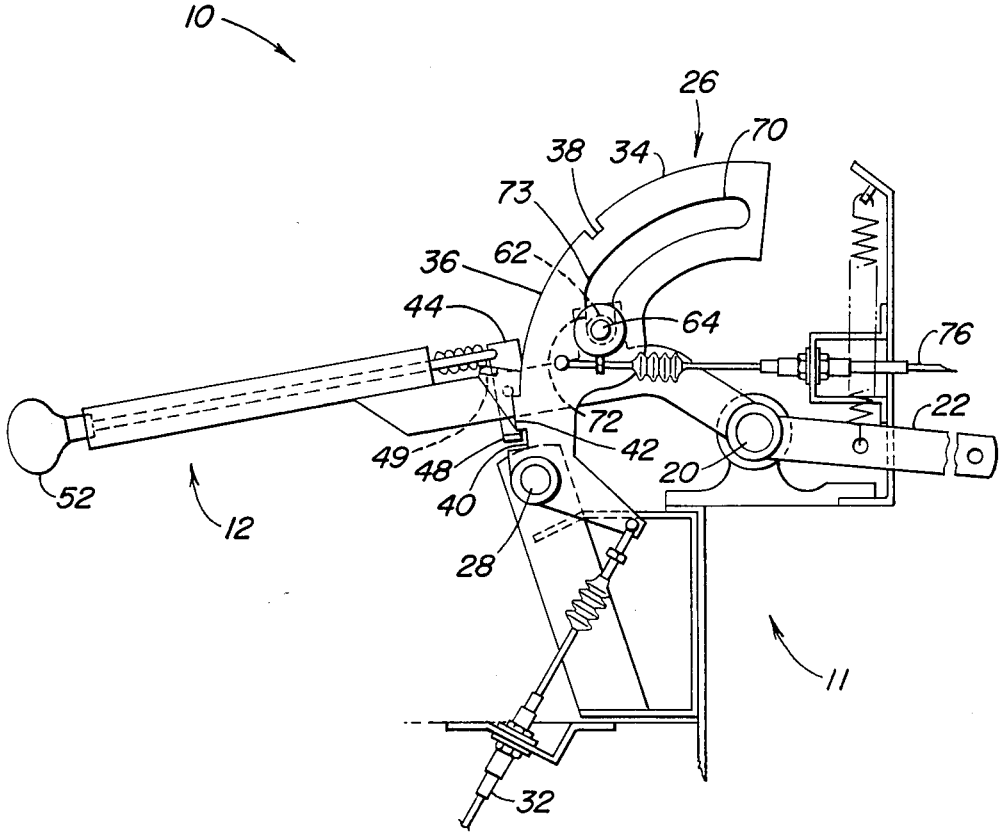
FIG. 3 is a view similar to FIG. 1 with the single control lever in a position for maintaining engagement of the reverse drive.

Selection of the reverse drive mode for the header conveyor system (lever position as in FIG. 3) requires deliberate manipulation of the control lever 12 and particularly the control knob 52 to take the detent tang 48 through the "gate" formed by the juxtaposition of the stop 49 and the abutment 42 of the "quadrant" and finally into engagement with the notch 40 for maintained engagement of the reverse drive train. The path of the detent tang or nose portion 48 through the gate is indicated by the locus 80 shown in FIG. 2.

A control arrangement according to the invention is simple and convenient and inherently robust and reliable. Operator input is through a single lever automatically controlling a second lever and, selectively, the actuation of two devices. The effective operating or actuating positions for the lever are on opposite sides of and separated by a common neutral position so that inadvertent simultaneous engagement of both devices is not possible. A gate at the neutral position forces a pause in shifting from actuation of one device to the other which is particularly useful when the devices are interrelated and it is desired that operation of one be positively interrupted before the other is engaged.

I claim:

1. A control arrangment for controlling at least two devices carried by the same machine, each device being engageable responsive to an actuator, comprising:

a frame carried by the machine;

a primary control lever connected to the actuator of the first device and carried by the frame for rocking motion about a first pivot axis between first and second positions corresponding respectively to engagement and disengagement of the first device;

a secondary control lever connected to the actuator of the second device and carried by the frame for rocking motion about a second pivot axis between first and second positions corresponding to respective engagement and disengagement of the second device, said second pivot axis being approximately parallel to and spaced from and in fixed relation to the first pivot axis;

a camming arrangement including a first camming element carried by the primary lever and a second camming element carried by the secondary lever, one of said elements including camming surfaces and the other of said elements including a cam follower engageable by the camming surfaces, said camming surfaces including a first range defining a circular arc concentric with the first pivot axis when engaged by the cam follower and a second range contigous with the first but diverging from the circular arc of the first range so that as the primary lever is moved within the first range, the first device is engaged while the secondary lever remains stationary and as the primary lever is moved in the second range, the secondary lever is displaced by the camming surface so that the second device is engaged; and means for arresting movement of the primary lever so as to impede its movement through a position corresponding to the junction between the first and second ranges.

2. The control arrangement of claim 1 wherein the actuators of the first and second devices are connected to their respective levers so that during progressive movement of the primary lever in a given direction, it passes through positions corresponding, in sequence, to maintained engagement of the first device, disengagement of the first device, engagement of the second device, maintained engagement of the second device.

3. The control arrangement of claim 1 wherein the camming assembly comprises a slot carried by the secondary lever and a cam follower carried by the primary lever.

4. The control arrangement of claim 1 wherein the means for impeding movement of the primary lever includes a stop on the secondary lever and latch means carried by the primary lever and selectively engageable with the stop.

5. The control arrangement of claim 4 wherein the primary lever movement impeding means includes offset abutments carried by the secondary lever disposed so that movement of the primary lever through the gate requires radial displacement of the latch.

6. The control arrangement of claim 1 wherein the camming surfaces define a continuous slot having opposite ends including a first end at the end of the arcuate portion and a second end at the end of the deviating portion, said ends defining stopped positions for the primary lever corresponding respectively to maintained engagement of the first device and maintained engagement of the second device.

* * * * *